US006675409B1

(12) United States Patent
O'Dell, Jr.

(10) Patent No.: US 6,675,409 B1
(45) Date of Patent: Jan. 13, 2004

(54) STAND FOR BED LOFTING

(75) Inventor: William H. O'Dell, Jr., Wilmington, DE (US)

(73) Assignee: Campus Loft Company, Inc., Newark, DE (US)

( * ) Notice: Subject to any disclaimer, the term of this patent is extended or adjusted under 35 U.S.C. 154(b) by 0 days.

(21) Appl. No.: 10/270,967

(22) Filed: Oct. 15, 2002

(51) Int. Cl.[7] ..... A47C 19/20
(52) U.S. Cl. ..... 5/9.1; 5/8; 5/11; 5/2.1
(58) Field of Search ..... 5/8, 9.1, 11, 201, 5/203, 208, 222, 202, 2.1

(56) References Cited

U.S. PATENT DOCUMENTS 7,791 A * 11/1850 Zaiser ..... 5/9.1
1,275,774 A * 8/1918 Silvester ..... 5/9.1
2,306,438 A * 12/1942 Hallock ..... 5/8
5,150,484 A * 9/1992 Whitten, Jr. ..... 5/9.1
5,233,707 A * 8/1993 Perkins ..... 5/8
5,575,023 A 11/1996 McCumber ..... 5/9.1
D404,992 S 2/1999 Sittig ..... D8/374
6,012,185 A 1/2000 Woods et al. ..... 5/509.1
D423,340 S 4/2000 Sittig ..... D8/374

* cited by examiner

*Primary Examiner*—Teri Pham Luu
*Assistant Examiner*—Fredrick Conley
(74) *Attorney, Agent, or Firm*—Jeffrey C. Lew

(57) ABSTRACT

A stand can support a conventional four-posted bed at an elevation substantially higher than floor level and provides open access to the greatly increased space beneath the bed. From above, the stand has a straight-sided-U shape with a leg at each corner. Two legs at the head and at the foot of the bed are connected by cross braces such that the stand has two opposing H-shaped end units. A a single longitudinal horizontally disposed truss extending along one side of the bed rigidly and strongly connects the end units.

18 Claims, 5 Drawing Sheets

STAND FOR BED LOFTING

FIELD OF THE INVENTION

This invention relates to a device for elevating a bed to provide useful space below the bed for storage or other purposes.

BACKGROUND OF THE INVENTION

Many types of beds and bed frames are in use. Commonly a rectangular mattress rests upon a rectangular frame supported by two posts linked by a head board structure and two posts linked by a foot board. Quite often the top surface of the mattress is positioned at such a height that the user can conveniently move onto the bed from a standing position. More specifically, the top of the mattress is about 24 inches above the floor. Consequently, there is usually less than about 8–12 inches of clearance beneath the bed between the bottom of the mattress-bearing frame and the floor.

In various circumstances living space is restricted. Examples include dormitory, prison, military, hostel, small private bedrooms and similar living arrangements. One method of maximizing the useful living space in some of these situations involves bunking beds. This solution calls for providing extended bed posts for a first bed and mounting a second bed directly above the first such that the bottom of the upper bed's posts sit on the top of the lower bed's posts. Bunking beds reduces the floor space in a room required for the beds and frees up the floor space otherwise occupied by the upper bed for other uses.

Bunking beds does not provide added usable space when only one person occupies a room. Also there are times when multiple occupants prefer not to have their beds placed in an upper-lower bunk arrangement. Bed lofting, that is, elevating the bed a distance greater than usual, is the method often employed in situations such as these.

Bed lofting generally involves raising the mattress and its immediately underlying support frame several feet so that the floor space beneath the frame is cleared for storage, desk space, entertainment system, e.g., electronic audio and video equipment, or other furniture placement or other uses. In perhaps simplest form, lofting might be done by extending the standard corner posts of the bed vertically and mounting the frame higher on the extended posts. This solution has the drawback that the bed is permanently configured for lofting. That is, if the user later desires to lower the bed to a conventional height or to move the bed to a different living space, the bed will remain at lofted height on its longer posts.

Another, more flexible approach calls for putting objects under the posts of a standard bed so that the bed is raised temporarily. For many years beds have been lofted in this way, primarily by students in university dormitory settings. A preferred low-cost technique utilizes cinder blocks placed under the four corner posts of a conventional dormitory bed.

Bed lofting with cinder blocks suffers from many disadvantages. Perhaps the most important is lack of safety. Typical cinder blocks have an elongated shape. To obtain greatest lofting height they are stood on their ends which have small base and top areas. Consequently, during normal use the bed posts are likely to slide off of a cinder block or the block is susceptible to falling over. These events can result in personal injury and/or damage to the bed or other furnishings. If the blocks are oriented on their side for greater stability, the blocks take up much of the floor space which they were intended to save. Cinder blocks also do not allow for adjusting the height of the lofted bed unless multiple blocks are stacked on each other. However, cinder blocks are very heavy and it is frequently extremely inconvenient to carry many blocks to a bed lofting location. Still further, cinder blocks create a disposal problem. Because they are so inexpensive, they are often left behind, for example, by dormitory students at the end of a school term. Thus the residence institution must attend to the laborious task of removing and disposing of the surplus blocks.

U.S. Des. Pat. Nos. 404,992 and 423,340 of Sittig disclose manufactured bed riser supports. These can be substituted for and may solve the stability and structural integrity problems of cinder blocks. However, they are limited to fixed height lofting and they can be misplaced or stolen due to their apparent portability. To achieve substantial lofting heights of about 2–3 feet, such bed riser supports would appear to be bulky and to take up considerable amount of floor space both below and around the outside of the perimeter of the bed.

Bed lofting is also accomplished by constructing a scaffold system to elevate a mattress and frame. U.S. Pat. No. 5,575,023 of McCumber and U.S. Pat. No. 5,150,484 of Whitten, Jr. provide representative examples of these. It is still desirable to provide a safe, structurally sound, durable and efficient bed lofting system. Especially in the university dormitory environment, there is a need for a bed lofting solution that is easily transportable to the user's location in a disassembled condition, rapidly assembled with a minimum of labor, adapted to withstand rough treatment, disassembled after use for compact storage, and which is capable of re-use for many cycles.

SUMMARY OF THE INVENTION

Accordingly, there is now provided a stand for lofting a bed supported at bedposts of the bed comprising

- an H-shaped first end unit having two vertically oriented legs adapted to be positioned opposite each other under head end bedposts of the bed,
- an H-shaped second end unit having two vertically oriented legs adapted to be positioned opposite each other under foot end bedposts of the bed, and
- a truss extending under one side of the bed and rigidly connecting the first end unit to the second end unit,
- in which each leg comprises a bottom extremity having a flat, horizontally oriented base, and a top extremity having a bedpost holder defined by an upwardly directed recess adapted to receive a foot of a bedpost,
- in which each end unit comprises a cross brace extending horizontally between the legs of the end unit, and
- in which the truss comprises (i) a main brace member positioned horizontally and fastened at one end to the leg of the first end unit and fastened at the opposite end to the leg of the second end unit, (ii) a support strut affixed at one end to the main brace member and fastened at the opposite end to the leg of the first end unit at a position vertically offset from the main brace member, and (iii) a support strut affixed at one end to the main brace member and fastened at the opposite end to the leg of the second end unit at a position vertically offset from the main brace member.

The novel bed lofting stand can be assembled with a small number of component parts, many of which are interchangeable.

DETAILED DESCRIPTION

Figure 1:
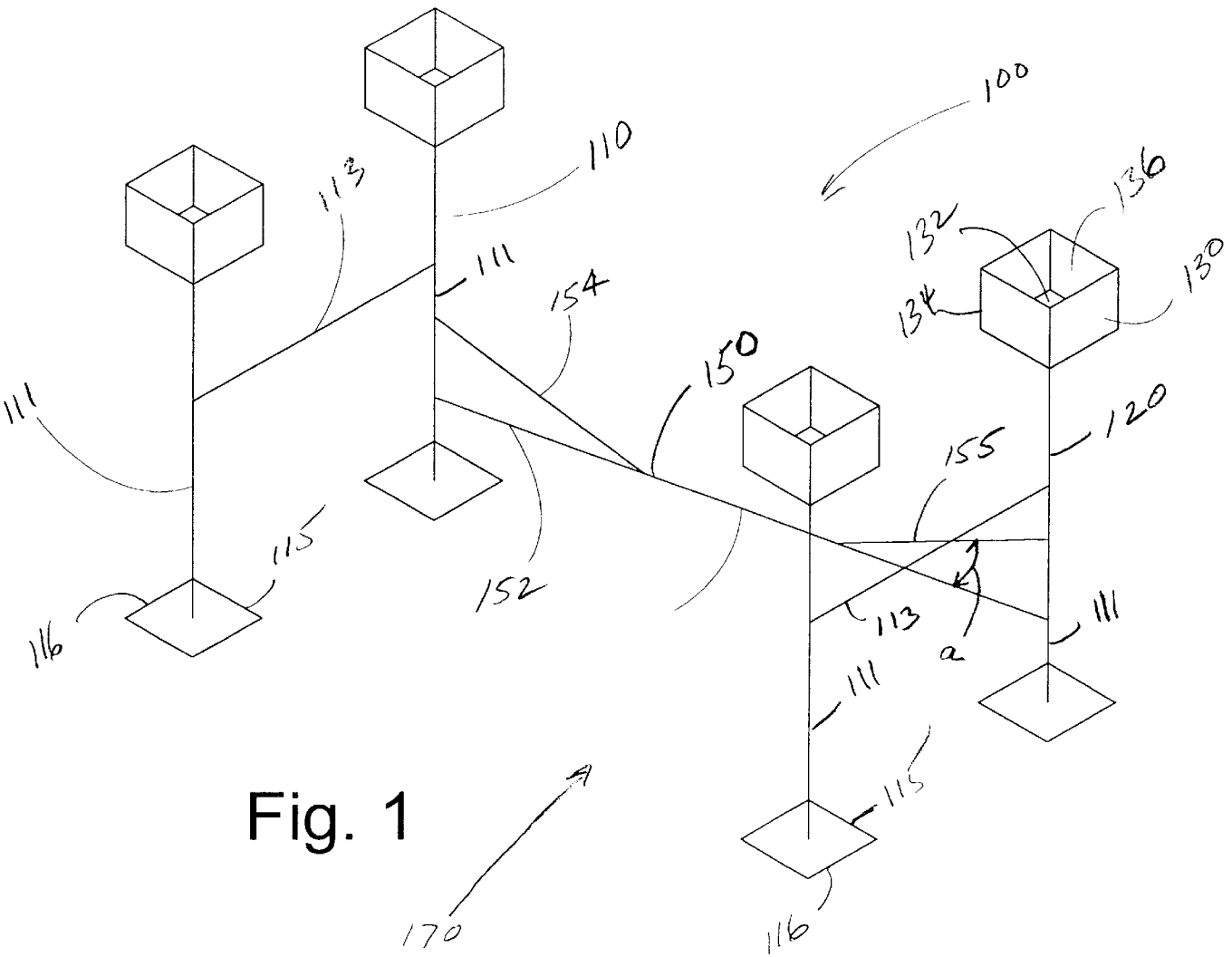
FIG. 1 is a schematic diagram in perspective view of an embodiment of the stand for bed lofting according to the present invention.

The structure of a basic embodiment of the novel stand for lofting a bed can be understood with reference to FIG. 1. The stand 100 has three major component groups, namely an H-shaped first end unit 110, an H-shaped second end unit 120, and a truss 150. Although they are identified as "first and second" and have been given different reference numbers, it is contemplated that the structure of the end units will be identical in virtually all practical implementations of this invention.

Figure 2:
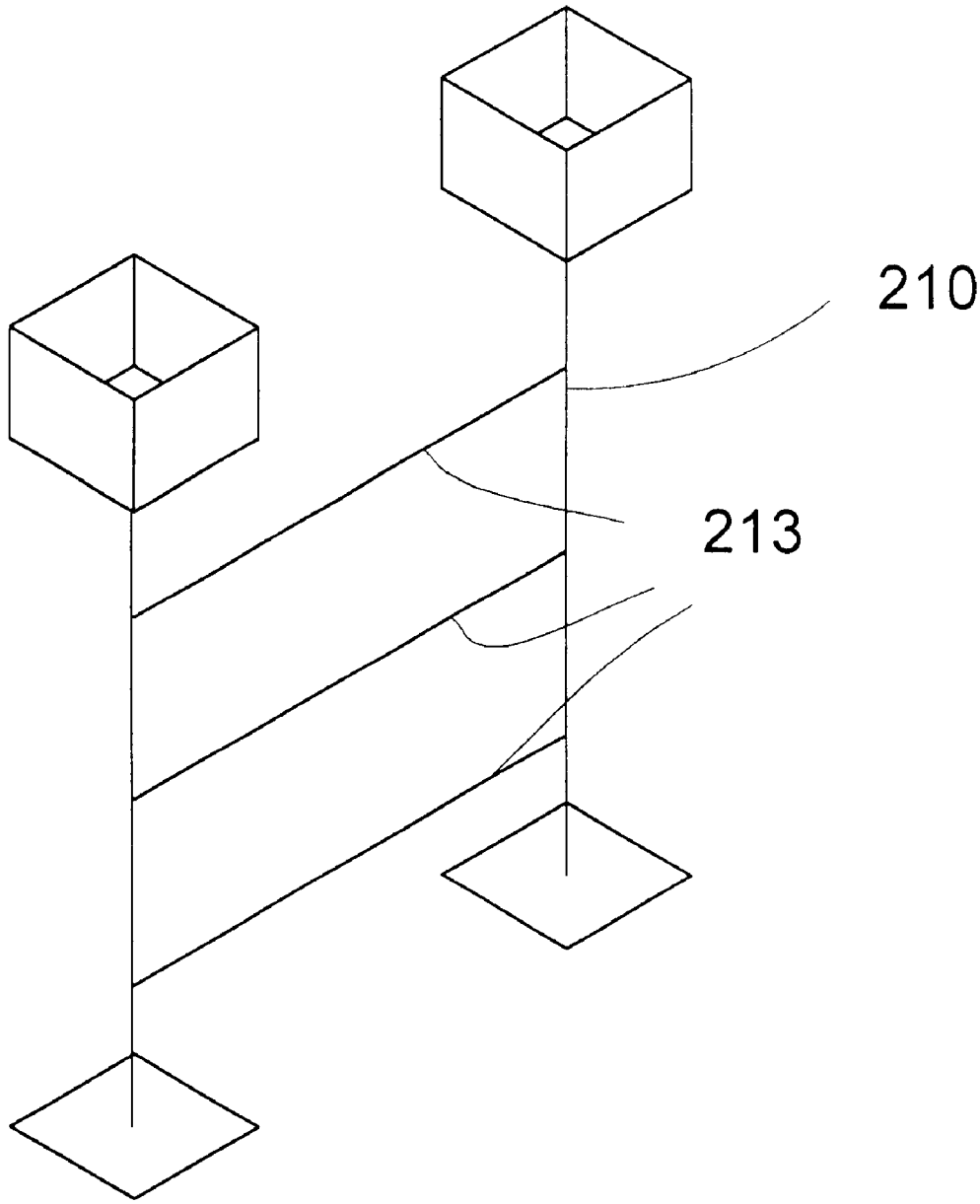
FIG. 2 is a schematic diagram perspective view of another embodiment of an end unit of the stand for bed lofting according to this invention.

Each end unit 110, 120, has two vertically oriented legs 111 and at least one cross brace 113 extending laterally between the legs. The juxtaposition of the legs and cross brace thus give the end units an H-shaped appearance. In preferred embodiments, and depending upon the overall height of the stand, one or both of the end units can have multiple, laterally extending cross braces. When multiple cross braces 213 (FIG. 2) are present, they are preferably all horizontally disposed and vertically offset from each other. The cross braces preferably have a flat, horizontal top surface. Flat topped cross braces thus serve the additional function of rungs upon which the user can step to climb onto the elevated bed mounted on the stand.

The end units are positioned facing each other at opposite ends, i.e., the head and foot of a rectangular bed. This positioning of the end units permits the legs of the stand to function as bed post risers. In common bed configurations the bedposts are at the extreme head and foot ends of the bed. The distance between legs and end units can be adjusted. Therefore, the novel stand can adapt to those beds of which the feet that support the bed are offset from the four corners of the bed, that is, usually closer to the center of the bed.

With further reference to FIG. 1 it is seen that all of the legs have a flat-bottomed, horizontally oriented base 115 located at the bottom extremity of the leg. The flat-bottomed base provides a stable platform that permits each end unit to stand upright on a flat floor without additional support. Depending on the configuration of the leg and cross brace structure, the flat base usually can also permit single legs to stand upright. This beneficial feature advantageously facilitates the assembly of the stand with reduced effort as will be explained below. Other than that the bottom should be adapted to stably align the leg substantially vertically, the shape of the base is not critical. Rectangular bases are illustrated, however, other shapes, such as circular, triangular, conical or pyramid-shaped, to name representative examples, can also be used. If the area of the bases is to small, the leg will be unstable. If the base areas are too large, they will intrude too far into the space below the bed and can reduce the effectiveness provided by the bed lofting. Preferably the area of each base coplanar with the floor of the room should be about 15–36 square inches, and more preferably about 25 square inches. Preference is given to placing the vertical member of the leg near a side 116 of base 115. This allows the frame to be positioned close to boundary walls of a room in which the novel stand is to be deployed. Consequently, the stand can fit within small rooms and alcoves that are very close in dimension to the length and/or width of the bed.

The end units are seen to also have a bedpost holder 130 at the top extremity of each leg. The bedpost holder is generally in the form of a cup defined by a support surface 132 surrounded by a perimeter wall 134. The wall and the support surface form a recess 136. As will be further explained, in use the bottom of the bed posts are positioned in the recesses so that the bedposts rest on the support surfaces. The wall retains the bedpost securely on the surface and thereby prevents the bed from falling off of the stand. The shape of the bedpost holder is not critical except that the recess should be large enough to accept the bottom of the bed post. It is not necessary that the bed post fit exactly in the recess with no lateral gap between the outer surface of the bedpost and the inner surface of the perimeter wall. That is, there can be lateral "play" to permit lateral movement of the bedpost within the recess. Preferably the area of the support surface of the bedpost holder, i.e., the area within the wall, should be about 9–16 square inches.

The height of the wall provides an important safety feature in that the wall keeps the bedpost from sliding off the stand legs. Preferably the height of wall, that is, the depth of the recess, should be at least about 0.5 inch, and more preferably at least about 1 inch. In some embodiments of the invention, the wall is continuous along the perimeter of the bedpost holder.

Figure 3:
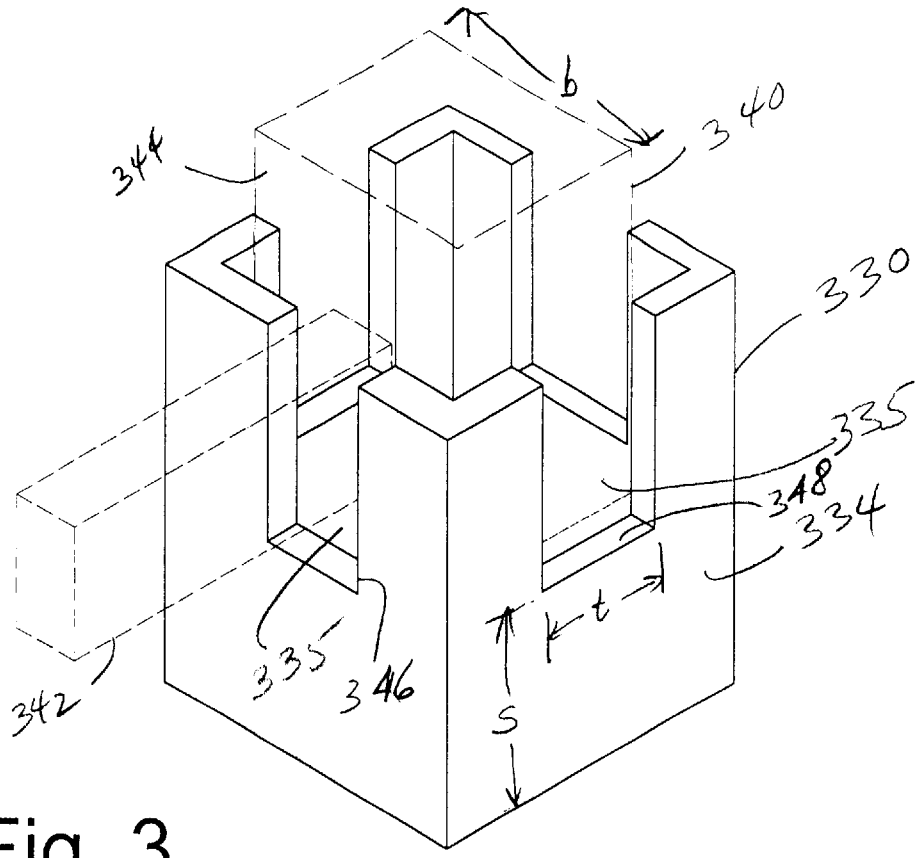
FIG. 3 is a perspective detail view of an embodiment of a crenelated bed post holder of the stand for bed lofting according to this invention.

In another embodiment the wall of the bedpost holder 330 has a crenelated structure as seen in FIG. 3. That is, the wall 334 defines at least one open-topped slot 335, also called a crenelation. These crenelations permit the stand to accommodate beds with bedpost frame members positioned vertically proximate to the bottom of the bedpost. For example, a truncated portion of a bed frame 340 with a low-to-the-ground frame member 342 is shown in phantom view in FIG. 3. Frame member 342 extends horizontally to another part of the bed, such as a different bedpost, not shown. Such a frame member would interfere with a high wall of the bedpost holder 130 (FIG. 1) and thus prevent the placement of the bedpost 344 into the recess. The crenelations allow the bedpost 344 to descend into the recess and still stop the post from sliding off the bedpost holder surface. If desired to render the legs of the end units interchangeable, preferably four crenelations are provided at 90 degrees from each other. Commonly, bedpost holders according to this invention have a single crenelation oriented on the leg such that the crenelations of opposite holders of the same end unit face toward each other. It has been found that in most cases, low frame members extend from side-to-side of the bed at the head or foot rather than along the long sides of the bed.

Figure 4:
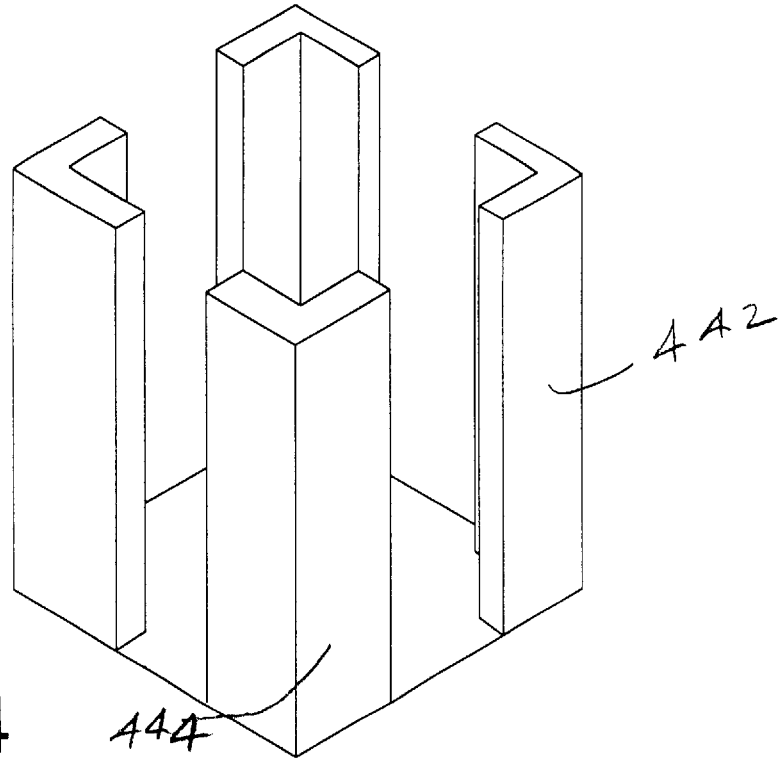
FIG. 4 is a perspective detail view of another embodiment of a crenelated bed post holder of the stand for bed lofting according to this invention.

The shape of the crenelations is not critical. The corners 346 may right-angle, as shown, rounded, chamfered or filleted, for example. The sill 348 is not intended to carry the weight of the bed. It is merely to let the bedpost fit deeply enough into the recess that the post rests upon the inside bottom of the bedpost holder. The dimensions s and t (FIG. 3) should be selected to be large enough to accept the horizontal frame member 342 without permitting the bedpost to escape from the recess. Typically, the dimension t should be in the range of about 0.5–2.5 inches and preferably the dimension s should be at least about 0.5 inch. Beds may utilize frame members that are positioned flush with the bottom of the bed post. For such beds, dimension s can be as low as zero, as the embodiment of FIG. 4 illustrates. For such an application, the dimension t should not exceed the width dimension b (FIG. 3) of the bedpost so that the post will safely be retained in the holder by wall portions 442 and 444 (FIG. 4).

The truss 150 rigidly connects the two end units to complete the structure of the novel stand. The truss is positioned along one side of the bed thus giving the stand an overall U-shape as viewed from above. When the stand and bed are deployed against a wall of a room, preferably the truss is positioned adjacent to a wall so as to provide free access to the space under the bed from the entrance 170 between the legs on the sides of the end units opposite the truss.

The truss 150 (FIG. 1) can be considered to have three major component members, namely a main brace 152, and two support struts 154, 155. The main brace extends horizontally between one leg on the first end unit and a corresponding leg on the second end unit. The struts 154, 155 are each affixed at one end to the main brace member. The struts are oriented at an acute angle a with the horizontal main brace. When assembled, the free ends of the supports are fastened to the same legs of the end units as the main brace. The free ends are thus vertically offset from the points where the main brace connects with the legs. This provides structural stability to the stand without excessively extending into the area under the bed. Preferably the acute angle a should be about 15–75 degrees, and more preferably about 30–60 degrees. The length of the truss is selected such that the distance between bedpost holders of facing end units corresponds to the head-to-foot distance between the bedposts of the bed being supported. Truss length can be adjusted, as will be explained.

Relative vertical positioning of the truss component members is not critical. That is, the support struts can be above or below the main brace and one support strut can be above the brace while the other is below. The main brace can be positioned vertically at any height of the legs. Preferably for stability during assembly and disassembly of the stand, the main brace should be within about one-third of the height of the legs from the bottom of the legs.

Figure 5:
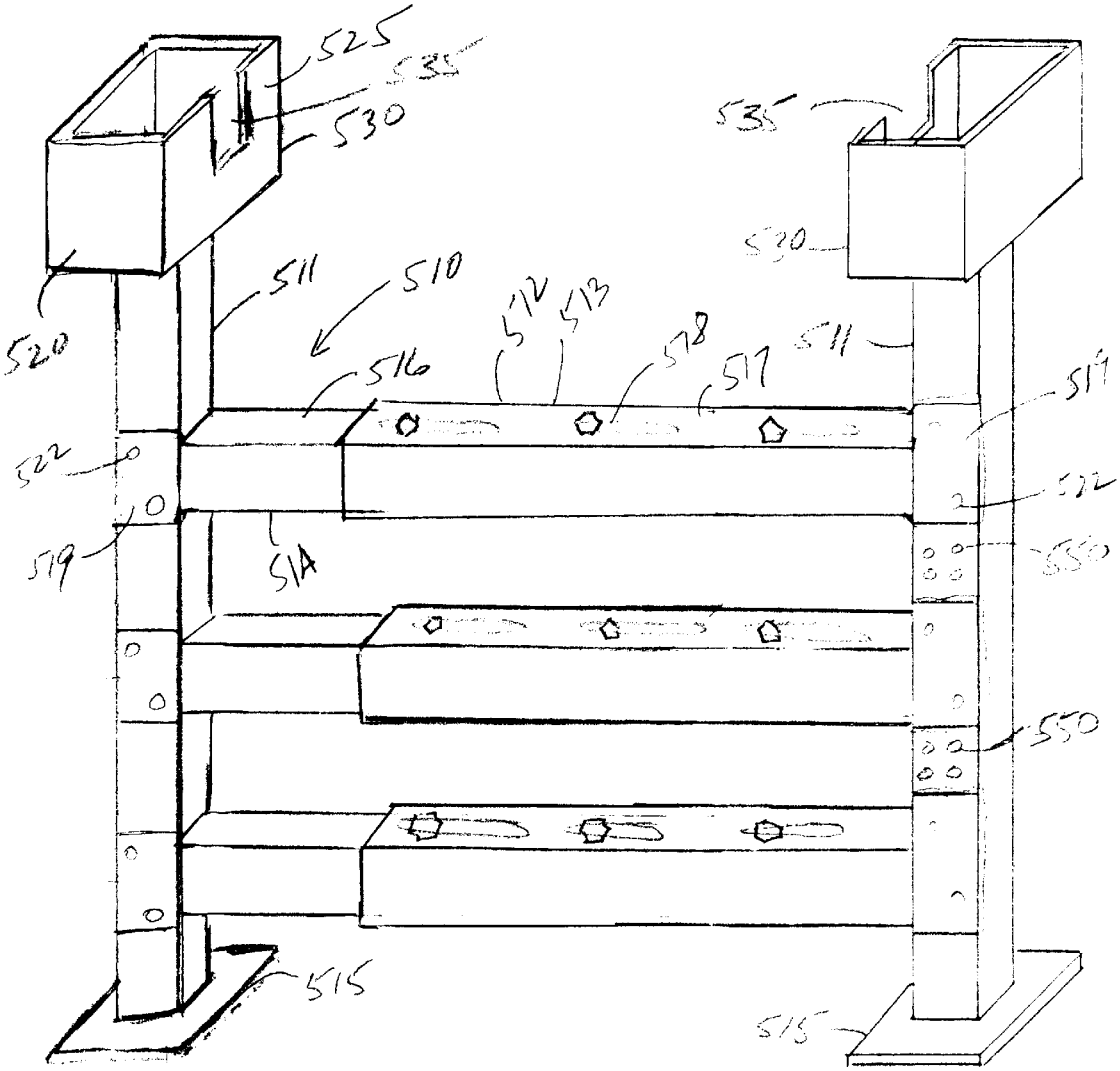
FIG. 5 is a perspective view of an end unit of a preferred embodiment of the present invention.
Figure 6:
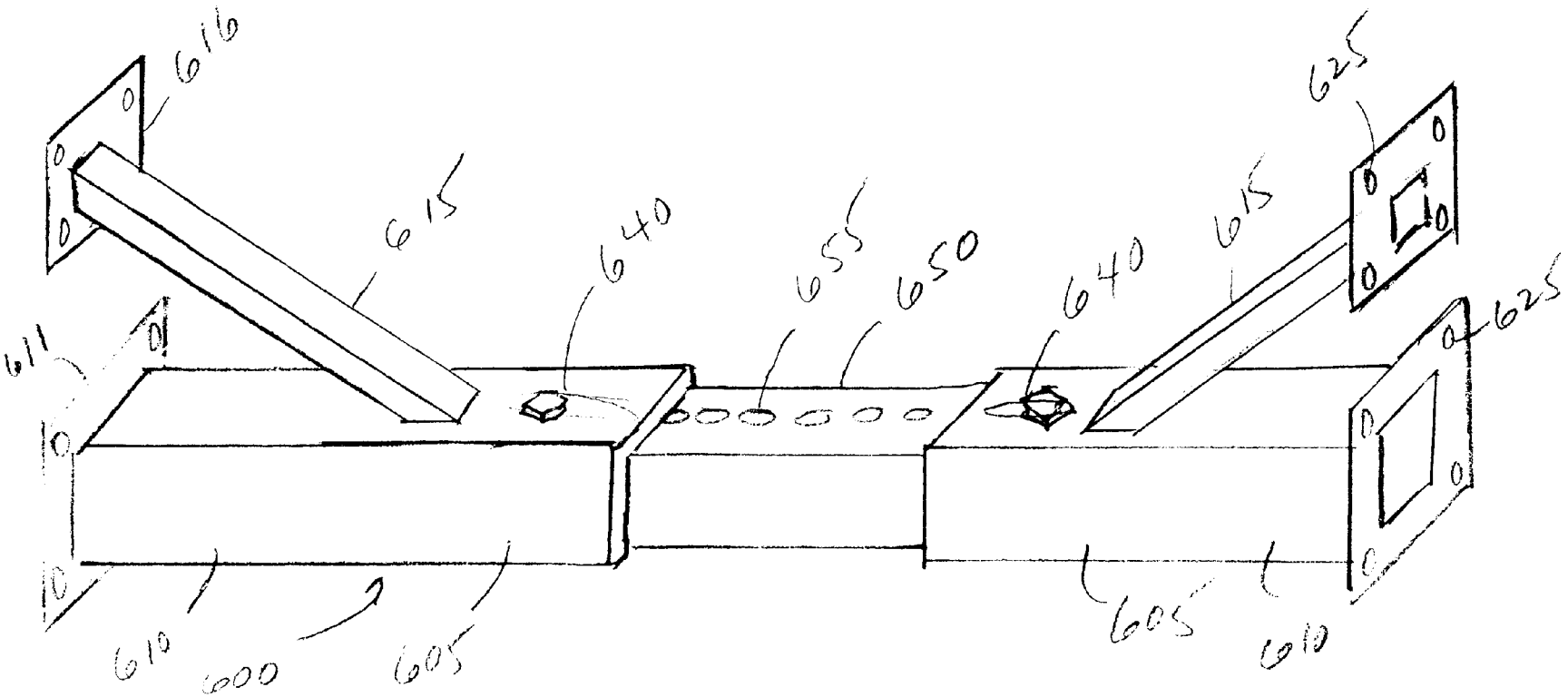
FIG. 6 is a perspective view of a truss of a preferred embodiment of the present invention.

The construction of a preferred embodiment of the novel lofting stand is best understood with reference to FIGS. 5 and 6. The elongated members and bedpost holders of the end units 510 were formed of about 1.5 mm thickness steel. Legs 511 were hollow rectangular cross section tubes of about 2 inches on each side. The legs extended about 36 inches from the top of the bases 515 to the bottom of the bedpost holders 530. The base plates were 5 inch×5 inch squares of 2 mm thickness steel welded to the bottom ends of legs 511. The bedpost holders were box shaped and had rectangular sides 520 measuring 5 inches high and 4 inches in lateral dimension. The face 525 of the bedpost holder was about 3.5 inches wide and included a single crenelation 535. Dimensions (FIG. 3) of the crenelation were about s=0.75 inch and t about 2.5 inches.

Pairs of legs were assembled together to form end units 510 using three cross braces 513. Each cross brace included a set of elongated inner member 514 and outer member 512. These members were formed of 1.5 mm thickness steel plate bent to a right angle, U-shaped cross section. The cross brace members were each about 20–22 inches long and the cross section dimensions were about 2.4 inches on each of the three "U" shape sides. One end of each cross brace member was extended to form a pair of flat ears 519. These ears had bolt holes 522 positioned to match the locations of similar sized holes in legs 511. Thus the ears 519 each cross member were adapted to embrace the vertical portion of the legs as shown in FIG. 5. The bolt holes were positioned on the legs to vertically separate the cross braces by about 12 inches. The inner member was slightly smaller in cross section and was adapted to mate with the outer member in telescoping manner. End unit distance between facing bedpost holders was thus adjusted to match the distance between bedposts by sliding an appropriate length of the inner member 514 into the outer member 512. The top surfaces 516, 517, of inner and outer members respectively had a plurality of elongated slots 518 adapted to be secured within a wide range of lateral distances by fastening bolts (not shown). When the distance between legs is adjusted correctly, the fastening bolts were tightened. The top surfaces 516, 517 were wide enough to also serve as steps for climbing onto the lofted bed following assembly. Preferably, the cross braces should be at least about 2 inches in width to provide sufficiently safe and comfortable footing for climbing up to the lofted bed. Two end units were assembled in the manner just described.

The assembled end units 510 were stood upright on their bases and placed approximating the distance between the foot and head bedposts of a bed to be mounted on the lofting stand. A truss 600 as shown in FIG. 6 was assembled from its component parts which included two identical support assemblies 605 and a tie bar 650. Each support assembly 605 included an approximately 35 inch long horizontal brace bar of hollow square cross section steel tubing 610. The horizontal brace bar tubing had about 40 mm×40 mm cross section dimensions and 1.5 mm wall thickness. To this horizontal brace bar was welded a support strut 615 of about a 20 inch length of 32 mm×32 mm hollow square steel tube of 1.6 mm thickness. The support strut 615 was affixed to the horizontal brace bar 610 at an angle of 30 degrees at a point intermediate the ends of the brace bar. Horizontal brace bars and struts terminated at their unit connector ends and free ends with square flanges 611 and 616, respectively. The flanges were drilled with bolt holes 625 adapted to receive bolts for fastening the truss to legs of the end units. Bolt holes 625 were positioned so as to align with holes 550 (FIG. 5) on one of the legs of each end unit. Prior fastening the support assemblies 605 to the legs, tie bar 650 was inserted into the bore of each support assembly at the tie connector end opposite the unit connector end of the horizontal brace bar. The tie bar was a hollow square steel tube about 30 inches long and having cross section dimensions adapted to mate with the horizontal brace bar in telescoping fashion. The tie bar was drilled with a plurality of bolt holes 655 spaced apart laterally from each other by a distance of about 1 inch. These bolt holes were positioned to align with slots 640 in the horizontal brace bars 610 and thereby permit adjusting and fixing the length between flanges 611 at the distance appropriate to position the bedpost holders below head and foot bedposts.

With the length of truss 600 properly adjusted, bolts were inserted through holes in flanges 625 and 550 to fasten the truss to both end units 510. Overall dimensions of the lofting stand are not critical. Typically, the cross braces are operative to adjust the width between bedpost holders of each end unit from about 28 to about 44 inches. The tie bar adjustment of distance between end units is usually in the range of about 77 to about 90 inches. The lofting stand assembled as described weighs about 120 lbs and raises the mattress of four post bed about three feet higher than bed elevation without the stand.

The height of the novel bed lofting stand, i.e., the length of the legs, can be made to any desired length giving due consideration to the length of the bedposts of the lofted bed and the ceiling height of the room in which the bed is lofted. Normally, the height of the bed lofting stand will be effective to raise the bed above the floor by about 2–4 feet and preferably about 2.5–3.5 feet. In one contemplated embodiment, the legs can be provided with height adjustment means to allow the height of the stand between the base and the bedpost holder to be varied within a preselected range. For example, the legs can have two parts of different tubular cross section dimensions such that an upper part mates with a lower part in telescoping fashion. Both leg parts can be pre-drilled with a series of vertically spaced apart holes that align as the upper part is moved longitudinally with respect to the lower part. When a desired height is achieved, a height fixing device, such as a fastening bolt or a pin can be inserted through the aligned holes. The weight of the upper part will settle on the bolt or pin which maintains the height of the leg at the desired elevation.

The novel bed lofting stand can be fabricated in modular or single piece construction. For example, the legs can be permanently affixed to cross braces to form modular end units. The sub-units of the truss can be permanently attached to form an integrated truss. As previously disclosed, it is preferred to fabricate the parts of the bed lofting stand such that they can be disassembled for transport and can be made size-adjusted to fit beds of different widths and lengths between bed posts within selected ranges. Preferably, the means for fastening the component parts of the bed stand are threaded bolts and complementary threaded nuts. It is contemplated that other permanent or removable fastening means common in the furniture or construction industry can be used.

Although specific forms of the invention have been selected for illustration in the drawings and the preceding description is drawn in specific terms for the purpose of describing these forms of the invention fully and amply for one of average skill in the pertinent art, it should be understood that various substitutions and modifications which bring about substantially equivalent or superior results and/or performance are deemed to be within the scope and spirit of the following claims.

What is claimed is:

1. A stand for lofting a bed supported at bed posts of the bed consisting essentially of an H-shaped first end unit having two vertically oriented legs adapted to be positioned opposite each other under head end bed posts of the bed, an H-shaped second end unit having two vertically oriented legs adapted to be positioned opposite each other under foot end bed posts of the bed, and a single truss extending under one side of the bed and rigidly connecting the first end unit to the second end unit, in which each leg comprises a bottom extremity having a flat, horizontally oriented base, and a top extremity having a bedpost holder defined by an upwardly directed recess adapted to receive a foot of a bedpost, in which each end unit comprises a cross brace extending horizontally between the legs of the end unit, and in which the truss comprises (i) a main brace member positioned horizontally and fastened at one end to the leg of the first end unit and fastened at the opposite end to the leg of the second end unit, (ii) a support strut affixed at one end to the main brace member and fastened at the opposite end to the leg of the first end unit at a position vertically offset from the main brace member, and (iii) a support strut affixed at one end to the main brace member and fastened at the opposite end to the leg of the second end unit at a position vertically offset from the main brace member.

2. The stand of claim 1 in which the truss comprises (1) two identical support assemblies each comprising (a) a horizontal brace bar defining a unit connector end and a tie connector end, and (b) a support strut disposed at an angle of about 15–75 degrees from horizontal and having one free end and an opposite end permanently joined to the brace bar at a location intermediate the unit connector end and the tie connector end, and (2) a tie bar positioned between the two support assemblies and removably fastened at opposite ends to the tie connector ends of the support assemblies such that the support assemblies and tie bar form a rigid truss, in which the truss is removably fastened by the unit connector ends and free ends to the first end unit and the second end unit.

3. The stand of claim 2 in which the truss comprises lengthening means for adjusting the length of the truss within a preselected range.

4. The stand of claim 3 in which the lengthening means comprises a hollow form extending longitudinally from the tie connector end of each brace bar and which is adapted to mate in a telescoping joint with an end of the tie bar.

5. The stand of claim 1 in which each end unit comprises a plurality of cross braces extending horizontally between the legs of the end unit and in which the cross braces have a flat horizontal top surface adapted to function as climbing steps to access a bed mounted on the stand.

6. The stand of claim 5 in which the cross braces are detachable from the legs.

7. The stand of claim 5 in which ends of each cross brace comprise ears adapted to embrace the leg of an end unit and each leg defines bolt holes aligned with the ears in a manner operative to permit the cross brace to be removably fastened to the leg and thereby form the H-shaped end unit.

8. The stand of claim 7 in which the end units comprise width adjustment means for adjusting the width of the end units between the legs within a preselected range.

9. The stand of claim 8 in which each cross brace comprises two opposing elongated beams, each elongated beam having one end comprising ears adapted to embrace the leg of the end unit and the opposite end of the beam having a cross section shape operative to mate in a telescoping joint with the other elongated beam of the cross brace.

10. The stand of claim 1 in which the recess has a depth effective to restrict lateral movement of the bottom of a bedpost such that during use the bed is prevented from falling off the stand.

11. The stand of claim 10 in which the recess has a sill plate adapted to contact the bottom of the bedpost and which recess is defined by walls extending upwardly at least about 6 inches above the sill plate.

12. The stand of claim 11 in which the walls have crenelations adapted to accept bed frame members positioned proximate to the bottom of the bedpost.

13. The stand of claim 12 in which the crenelations are flush with the sill plate.

14. The stand of claim 1 in which the legs comprise height adjustment means for adjusting the height of the legs between the base and the bedpost holder within a preselected range.

15. A stand for lofting a bed supported at bed posts of the bed comprising an H-shaped first end unit having two vertically oriented legs adapted to be positioned opposite each other under head end bed posts of the bed, an H-shaped second end unit having two vertically oriented legs adapted to be positioned opposite each other under foot end bed posts of the bed, and a truss extending under one side of the bed and rigidly connecting the first end unit to the second end unit, in which each leg comprises a bottom extremity having a flat, horizontally oriented base, and a top extremity having a bedpost holder defined by an upwardly directed recess adapted to receive a foot of a bedpost, in which each end unit comprises a cross brace extending horizontally between the legs of the end unit, in which the truss comprises (i) a main brace member positioned horizontally and fastened at one end to the leg of the first end unit and fastened at the opposite end to the leg of the second end unit, (ii) a support strut affixed at one end to the main brace member and fastened at the opposite end to the leg of the first end unit at a position vertically offset from the main brace member, and (iii) a support strut affixed at one end to the main brace member and fastened at the opposite end to the leg of the second end unit at a position vertically offset from the main brace member, and in which the truss comprises (1) two identical support assemblies each comprising (a) a horizontal brace bar defining a unit connector end and a tie connector end, and (b) a support strut disposed at an angle of about 15–75 degrees from horizontal and having one free end and an opposite end permanently joined to the brace bar at a location intermediate the unit connector end and the tie connector end, and (2) a tie bar positioned between the two support assemblies and removably fastened at opposite ends to the tie connector ends of the support assemblies such that the support assemblies and tie bar form a rigid truss, and in which the truss is removably fastened by the unit connector ends and free ends to the first end unit and the second end unit.

16. A stand for lofting a bed supported at bed posts of the bed comprising an H-shaped first end unit having two vertically oriented legs adapted to be positioned opposite each other under head end bed posts of the bed, an H-shaped second end unit having two vertically oriented legs adapted to be positioned opposite each other under foot end bed posts of the bed, and a truss extending under one side of the bed and rigidly connecting the first end unit to the second end unit, in which each leg comprises a bottom extremity having a flat, horizontally oriented base, and a top extremity having a bedpost holder defined by an upwardly directed recess adapted to receive a foot of a bedpost, in which each end unit comprises a plurality of cross braces extending horizontally between and being detachable from the legs of the end unit and in which the cross braces have a flat horizontal top surface adapted to function as climbing steps to access a bed mounted on the stand, and in which the truss comprises (i) a main brace member positioned horizontally and fastened at one end to the leg of the first end unit and fastened at the opposite end to the leg of the second end unit, (ii) a support strut affixed at one end to the main brace member and fastened at the opposite end to the leg of the first end unit at a position vertically offset from the main brace member, and (iii) a support strut affixed at one end to the main brace member and fastened at the opposite end to the leg of the second end unit at a position vertically offset from the main brace member.

17. A stand for lofting a bed supported at bed posts of the bed comprising an H-shaped first end unit having two vertically oriented legs adapted to be positioned opposite each other under head end bed posts of the bed, an H-shaped second end unit having two vertically oriented legs adapted to be positioned opposite each other under foot end bed posts of the bed, and a truss extending under one side of the bed and rigidly connecting the first end unit to the second end unit, in which each leg comprises a bottom extremity having a flat, horizontally oriented base, and a top extremity having a bedpost holder defined by an upwardly directed recess adapted to receive a foot of a bedpost, in which each end unit comprises a plurality of cross braces extending horizontally between the legs of the end unit and in which the cross braces have a flat horizontal top surface adapted to function as climbing steps to access a bed mounted on the stand, in which ends of each cross brace comprise ears adapted to embrace the leg of an end unit and each leg defines bolt holes aligned with the ears in a manner operative to permit the cross brace to be removably fastened to the leg and thereby form the H-shaped end unit, and in which the truss comprises (i) a main brace member positioned horizontally and fastened at one end to the leg of the first end unit and fastened at the opposite end to the leg of the second end unit, (ii) a support strut affixed at one end to the main brace member and fastened at the opposite end to the leg of the first end unit at a position vertically offset from the main brace member, and (iii) a support strut affixed at one end to the main brace member and fastened at the opposite end to the leg of the second end unit at a position vertically offset from the main brace member.

18. A stand for lofting a bed supported at bed posts of the bed comprising an H-shaped first end unit having two vertically oriented legs adapted to be positioned opposite each other under head end bed posts of the bed, an H-shaped second end unit having two vertically oriented legs adapted to be positioned opposite each other under foot end bed posts of the bed, and a truss extending under one side of the bed and rigidly connecting the first end unit to the second end unit, in which each leg comprises a bottom extremity having a flat, horizontally oriented base, and a top extremity having a bedpost holder defined by an upwardly directed recess adapted to receive a foot of a bedpost, the recess having a depth effective to restrict lateral movement of the bottom of the bedpost such that during use the bed is prevented from falling off the stand and having a sill plate adapted to contact the bottom of the bedpost, and which recess is defined by walls extending upwardly at least about 6 inches above the sill plate in which the walls have crenelations adapted to accept bed frame members positioned proximate to the bottom of the bedpost, and in which each end unit comprises a cross brace extending horizontally between the legs of the end unit, and in which the truss comprises (i) a main brace member positioned horizontally and fastened at one end to the leg of the first end unit and fastened at the opposite end to the leg of the second end unit, (ii) a support strut affixed at one end to the main brace member and fastened at the opposite end to the leg of the first end unit at a position vertically offset from the main brace member, and (iii) a support strut affixed at one end to the main brace member and fastened at the opposite end to the leg of the second end unit at a position vertically offset from the main brace member.

* * * * *